US006237694B1

(12) United States Patent
Chan

(10) Patent No.: US 6,237,694 B1
(45) Date of Patent: May 29, 2001

(54) EXPLOSION-PROTECTING AND EXTINGUISHING SAFETY DEVICE

(76) Inventor: Hunghon Chan, Room 815, Fai Lam House, Tsui Lam Estate, Tseung Kwan (HK)

( * ) Notice: Subject to any disclaimer, the term of this patent is extended or adjusted under 35 U.S.C. 154(b) by 0 days.

(21) Appl. No.: 09/147,881

(22) PCT Filed: Sep. 5, 1997

(86) PCT No.: PCT/CN97/00093

§ 371 Date: Mar. 18, 1999

§ 102(e) Date: Mar. 18, 1999

(87) PCT Pub. No.: WO98/11948

PCT Pub. Date: Mar. 26, 1998

(30) Foreign Application Priority Data

Sep. 20, 1996 (HK) ..... 96210563

(51) Int. Cl.[7] ..... A62C 2/00; A62C 8/00

(52) U.S. Cl. ..... 169/43; 169/45; 169/48; 169/66

(58) Field of Search ..... 169/43, 45, 48, 169/54, 66; 220/88.1, 88.2, 89.1

(56) References Cited

U.S. PATENT DOCUMENTS 2,912,054 * 11/1959 Mathisen ..... 169/66 X
5,415,233 * 5/1995 Roussakis et al. ..... 169/48
5,794,707 * 8/1998 Alhamad ..... 169/66 X

* cited by examiner

*Primary Examiner*—David A. Scherbel
*Assistant Examiner*—Davis Hwu
(74) *Attorney, Agent, or Firm*—Jenkens & Gilchrist, P.C.

(57) ABSTRACT

An explosion-protection and extinguishing safety device for inflammable liquid storage tanks. An aperture of a predetermined size located on the top of a tank is controlled by a switch device of an automatic switching system. The switch device of the aperture is closed under normal conditions and automatically opened when the internal pressure of the tank or the temperature of the wall of the tank is above a preset value. Application of heat to the tank results in vapor discharge to prevent explosion of the tank. The discharged vapors are burned above the aperture to eliminate external accumulate of the inflammable vapors.

10 Claims, 5 Drawing Sheets

EXPLOSION-PROTECTING AND EXTINGUISHING SAFETY DEVICE

BACKGROUND OF THE PRESENT INVENTION

This invention involves explosion-protecting and extinguishing safety devices for flammable liquid storage tanks under high temperature.

TECHNICAL BACKGROUND

Recovering, refining, storing and transporting of petroleum and flammable liquids requires the use of oil depots, fuel tank cars (including oil trains) and fuel tanks. All of these involve tanks and the tanks are sealed for protection by an outer covering. There is a rare chance for flammable liquid in the tank to touch a tinder directly and cause firing. This is caused by the intrinsic nature of flammable liquids. When there is an external heat conduction, e.g. a lightning strike outside, high temperature is generated on the outer covering of the tank and causes the flammable liquid in the tank to evaporate causing the pressure inside the tank to increase sharply. The explosion will occur right away and cause a firing when the bearing strength of the tank cannot withstand the vapor pressure. The explosion becomes a new tinder and heat source which will threaten other tanks. The intensity of firing will expand and spread continuously. The situation can be harmful to humans, property and the environment. Furthermore, once the burning oil is extinguished, the remaining oil will become waste product because the fire-extinguishing chemicals are often absorbed by the oil. Also a great quantity of manpower and material resources are consumed in the course of rescue.

Cooling methods are a common technique requiring a great quantity of coolant to prevent fire expansion and spreading. Chemical foam fire-extinguishing agents are less effective for oil firing in large areas. Explosion extinguishing methods and water spray methods using jet engines are also impractical for large-area oil firing in the tank. Up to now, there is no effective extinguishing method for the large area firing of flammable liquid in the tank.

An existing technique described in Su787046 generally describes an extinguishing device including a chamber with pipes parallel with the chamber side surface walls. The device is placed in a trough under the liquid storage tank. In an embodiment of this device used for extinguishing a flaming liquid, there is a very large volume under the pipes, i.e. the length of the pipe is shorter than the height of the holder. In an alternate embodiment, the length of the pipe is equal to the height of the receiver and holes are drilled on part of the pipe's wall. Thus, Su787046 generally describes a device which can make the burning liquid flow into the receiver of the device wherein the extinguishing is carried out.

Su1463317 also generally describes an extinguishing device including column shaped pipes having large bores therein. Additionally, the pipes have deflectors with angles calculated to be the ratio of the pipe diameter to the pipe top section length. However, the fire prevention and extinguishing of flammable liquid in the system described suffers from a number of deficiencies.

First, no explosion-protecting measures are described. As the tank of flammable liquid is a sealed type tank, explosion is likely to occur when subjected to heat. If the safety device is installed in the tank, the safety device will be destroyed and lose its function of fire prevention and extinguishing when explosion occurs.

Second, as the pipes must be spread over the entire cross section of the tank, a great quantity of space in the tank is occupied by the device itself.

Furthermore, the functions of fire prevention and extinguishing can be effective only under the condition of normal atmospheric temperatures. If the outer covering is elevated to a high temperature or the liquid's temperature is elevated to its boiling point, the device will lose its effective function.

Therefore, the challenge of liquid explosion-protection of a flammable liquid tank is the first technical difficulty to be solved. When the flammable liquid in the sealed tank is under the influence of an external heat source, explosion does not occur immediately but rather the flammable liquid temperature will go up continuously and a corresponding vapor will be produced unceasingly. The vapor is accumulated continuously and thus the pressure of the tank is increased unceasingly. Explosion and combustion may then occur when the mechanical strength of the tank can no longer withstand the pressure of the vapor. Therefore, controlling the vapor pressure and venting the vapor are the key to the explosion-protection. If there is an aperture or many apertures on the tank and these apertures are shut normally, these apertures may be opened to vent the accumulation of vapor in the tank when the vapor pressure exceeds the working pressure of the tank. Alternatively, the apertures may be opened when the wall of the tank reaches a certain temperature thereby preventing an explosion.

SUMMARY OF THE INVENTION

A main object of the invention is to provide an explosion-protection and extinguishing safety device for a flammable liquid storage tank. After eliminating the influence of an external heat source, the flame above the flameout device can be automatically extinguished so that it does not itself become new tinder. An aperture, or multi-apertures, is opened on the top of a flammable liquid storage tank. The size of the aperture is stipulated so that the aperture is opened automatically at a specified temperature and the vapor is let out continuously to avoid explosion when there is an external heat source causing the pressure inside the tank to increase or elevating the temperature of the tank's wall. This is a suitable method of explosion-protection for a flammable liquid tank. However, the flammable liquid in the tank may burn when the tank apertures are open. Metal net or corrugated metal is an effective fire obstructor. If these fire obstructors are installed at the apertures of the top of the tank, a flame can be blocked from reaching the liquid surface by way of the venting apertures. After the external heat source's influence has been eliminated, the flame above the obstructor still burns continuously until the liquid in the tank has vaporized completely. In fact, if a metal net or a corrugated metal fire obstructor is installed in the aperture above the tank, the fire obstructor impedes the flow of vapor. The obstructor may even impede the vapor from venting to the extent that the accumulated vapor will reach a high enough pressure to expel the obstructor. The present invention improves on the prior art by providing a flameout device installed above the vapor-vent of the tank thereby providing less resistance to vapor flow.

BRIEF DESCRIPTION OF THE DRAWINGS

A more complete understanding of the method and apparatus of the present invention may be had by reference to the following detailed description when taken in conjunction with the accompanying drawings wherein.

DETAILED DESCRIPTION OF THE DRAWINGS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
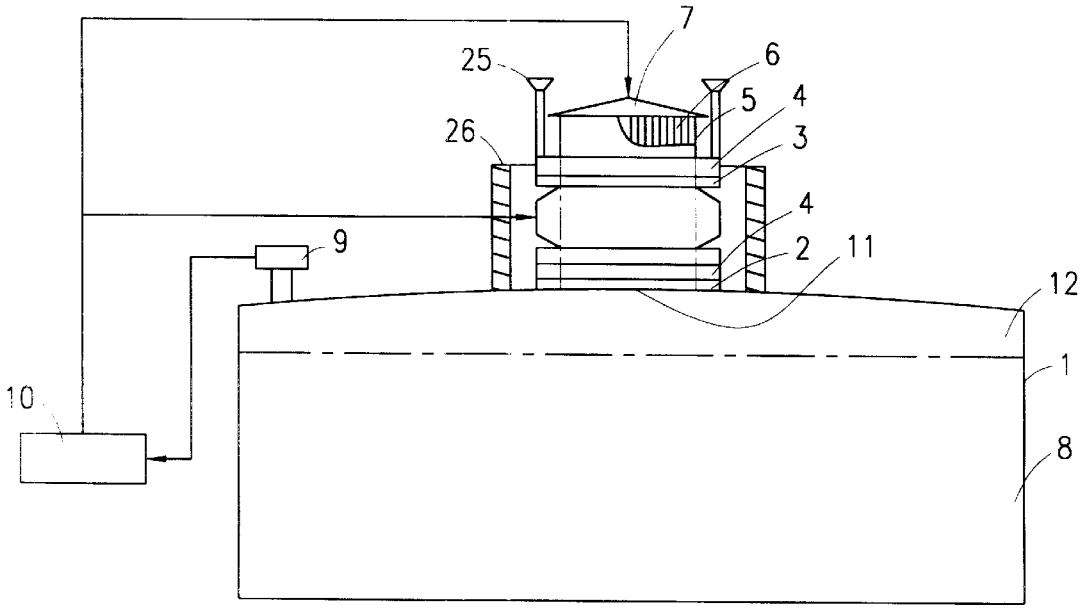
FIG. 1, FIG. 2 and FIG. 3 illustrate an embodiment of an explosion-protection and extinguishing safety device for a flammable liquid storage tank in accordance with the principles of the present invention.

In FIG. 1 is illustrated an exemplary flammable liquid storage tank and associated explosion-protection and extinguishing system according to a preferred embodiment of the present invention. Through experiment it has been shown that when the supporting strength of tank 1 is 1.6 kg/cm$^2$ and the tank is closed, i.e. no venting is provided, with the liquid in tank 1 in a boiling state, the ratio of aperture area $S_0$ of tank 1 to volume V (Liters) of tank 1 to provide sufficient explosion prevention is:

$$y=S_0/V>1.4\ \text{mm}^2/\text{liter, i.e., } S_0>1.4\ \text{Vmm}^2$$

Thus, if the minimum safety bore of aperture 11 necessary for preventing tank 1 from explosion is D, then $$D \le \sqrt{\frac{4S}{\Pi}} > \sqrt{4\times 1.4V/\Pi\,\text{liter}}\ \text{mm}^2 = \sqrt{1.78V/\text{liter}}\ \text{(mm)},$$

$$i.e.\ D \le \sqrt{1.78V/\text{liter}}\ \text{(mm)}$$

Because the wall thickness d of the pillar-shaped pipe in flameout device 5 occupies some part of the section, this becomes an obstruction to vapor flow. In order to eliminate the obstruction, the above formula is revised:

$$S_o\sim\geqq\sim 1.4\ \text{V}(1+K)/\text{liter (mm}^2);\ D\sim\geqq\sim\sqrt{1.78(1_k/\text{litermm}}$$

where K is a quantity describing the thickness of the pipe wall that forms the obstruction to vapor flow and relates the shape and diameter of the pipe. Formulations of K, also referred to as the obstruction parameter, are given below for various pipe shapes, d specifying the pipe wall thickness in all formulations given: For column-shaped pipes: K=4.68 d/$D_o$, where $D_o$ is the diameter of column-shaped pipe; for square pillar-shaped pipe: K=2 d/$D_o$, where $D_o$ is diameter of the inscribed collar of square shape; for equilateral hexagon pillar-shaped pipe: K=1.9 d/$D_o$, where $D_o$ is diameter of inscribed collar of equilateral hexagon shape; and for an isosceles trapezoid pillar-shaped pipe: K=2 d/$D_o$ where $D_o$ is the height of the isosceles trapezoid or average value of the top side and bottom side.

Thus, the section area of aperture 11 on the top surface of tank $S_o$ is defined as:

$$S_o\geqq 1.4(1+K)\text{V/liter mm}^2,\ \text{or } S_o>1.4(1+K)n\ \text{V/liter mm}^2,$$

where n is a safety coefficient for explosion-protection and is greater than or equal to one. Therefore, the bore diameter D of a circular aperture on the top surface of tank 1 is given by:

$$D\geqq\sqrt{\sqrt{1.78\text{V}(1+30K)/\text{liter}}}\ \text{mm or } D=\sqrt{\sqrt{1.78\text{V}(1+30K)/\text{liter}}}\ \text{mm}$$

where V is the volume (Liters) of the flammable liquid storage tank.

The vented vapor will be burned by flameout device 5. An isolation layer is provided between the flammable liquid and the air in the tank formed by the vapor of the flammable liquid that exists in the column-shaped pipe of the flameout device. The vapor forms a flow that stops external air from entering into the tank. Therefore, the flame cannot ignite the vapor and thus the liquid in the tank is correspondingly protected from igniting. The isolation layer plays an effective role in preventing fire and may be appropriately maintained when the following conditions are satisfied:

$$H=3D_o(\sqrt{\sqrt{D}}+1)^2,\ \text{D}_o<25\ \text{mm},\ S_o\leqq S/25,$$

where $D_o$ is the diameter of the column-shaped pipe in the flameout device 5, H is the height of the pipe; $S_o$ is the sectional area of the tank aperture 11, S is the cross sectional area of the liquid storage tank 1, and D is the cross sectional diameter (m) of the aperture.

For the tank 1 filled with a large quantity of flammable liquid, the liquid in the tank will produce a great quantity of flammable vapor when the tank's wall is under the influence of a high temperature heat source. The flammable vapor vents out from the aperture and it will burn when meeting with fire. In the present invention, this flame is burning above the flameout device. Once the influence of the external heat source on the heating tank has been eliminated, the flame above the flameout device 5 will be extinguished automatically. Therefore, the tank 1 will not itself become a new heat source respective to other nearby tanks.

In extinguishing tests of the invention, it is known that the method of putting out the flame above the flameout device is to heat the liquid in the tank. A certain quantity of gasoline is arranged around the tank and ignited thereby heating the liquid in the tank. Many combustible liquids produce a greater quantity of flammable vapor at elevated temperatures thereby causing the flameout device to burn more intensely. The flame above the flameout device 5 will extinguish automatically when a given quantity of the gasoline has been burnt out and the burning stops. For explosion-protection, the vapor in tank 1 is vented when a firing occurs, i.e. when the liquid in tank 1 is elevated in temperature due to an external heat source, and it will be ignited when meeting with a flame. The flame is above the flameout device 5. Because the liquid in the tank is heated by the firing, the flame above the flameout device burns more intensely in coordination with the increase of flammable vapor exhausted through aperture 11. Accordingly, the temperature of the flameout device 5 rises, until the fire stops heating the tank, the heating effect of the flammable liquid causing the flammable vapor quantity in tank 1 to decrease quickly. Under the action of a high temperature in flameout device 5, the flammable vapor decreases until insufficient vapor exists for combusting. At this point, the flameout device 5 is also extinguished. The essential conditions for extinguishing the flameout device 5 are:

$$H=3D_o(\sqrt{\sqrt{D}}+1)^2,\ D_o<25\ \text{mm},\ S_o\leqq S,$$

Thus, the essential and sufficient conditions for explosion-protecting, fire prevention and extinguishing of the tank 1 are:

$$H=3D_o(\sqrt{\sqrt{D}+1})^2,\ D_o \leqq Ø25\ \text{mm},\ S/25 \geqq S_o \geqq 1.4V(1+K)/\text{liter}(\text{mm}^2)$$

where $D_o$ is the bore diameter of the column-shaped pipe in the flameout device; H is the height of the pipe; $S_o$ is the section area of the tank's aperture; S is the cross-sectional area of tank 1; V is the volume (L) of liquid stored in the tank, D is the diameter (m) of the tank's aperture section, and K is the obstruction parameter of the wall thickness.

In experiments carried out during the perfection of the invention, the pillar-shaped pipe was selected for the flameout device. When its cross section was 283±80 $mm^2$, the most suitable explosion-protection and extinguishing characteristics were had. The bore diameter of the corresponding basic-shaped pipe $D_o$ is:

a) for column-shaped pipe, $D_o$=19±3 mm b) for inscribed collar of square shape, $D_o$=17±3 mm c) for an equilateral hexagon's inscribed collar, $D_o$=18±3 mm d) and $D_o$=17±3 mm for an isosceles trapezoid shape Therefore, the average bore diameter of a pillar-shaped pipe is $D_o$=18±3 mm, with a thickness of pipe wall d=0.4±0.1 mm.

Producing, enhancing and extinguishing of the flame above the flameout device 5 corresponds to the procedure of producing, increasing and decreasing the inflammable vapor. It involves the heating or removal of external heating of the inflammable liquid in tank 1 and the corresponding heat effect procedure of inflammable liquid and vapor. The invention uses this heat effect to control fire of the flameout device 5 by heat and to control fire of the flameout device 5 by fire so as to achieve extinguishing the flameout device 5. Therefore, this fire extinguishing method is referred to as a fire-extinguishing method of heat effect.

The fire-extinguishing method in the invention is a fire-extinguishing method by heat effect that uses neither water nor any existing fire-extinguishing chemical. Generally, the most commonly used methods for fire-extinguishing are the separation method, suffocation method, cooling method and inhibiting method. All are generally notutilized until the combustion occurs. The method according to the present invention places first priority on fire prevention and explosion-protection. However, in the event a fire is not prevented, the heat effect extinguishing method mentioned hereinabove differs from the existing methods which use fire-extinguishing chemicals to isolate the combusting material from air and flame. In the present invention, the isolation layer is formed by vapor on the liquid surface in the tank 1. No matter what size the liquid surface is, the isolation layer can cover the entire liquid surface. The extinguishing method utilizing fire-extinguishing chemicals is unable to achieve this, especially when large area oil firing occurs in a tank 1. Even using the most advanced fire-extinguishing chemicals, it is difficult to isolate the entire large area of the boiling liquid surface from flame and air. It is even more difficult to isolate them at the same time. Spraying fire-extinguishing chemical on the oil surface also causes the liquid in tank 1 to mix with the chemical often destroying the liquid whereupon it must be disposed after extinguishing. Atmospheric wind intensity also introduces difficulties to ordinary extinguishing methods while the heat effect extinguishing method described herein is immune to such effects.

It is apparent that the flame strength and burn time above flameout devices, from its production to extinguishment, are closely related to the heat source or fire external to the tank. Controlling the influence of the heat source or fire outside is a very important problem. To solve this problem, diversion troughs must be set up around the tank. The use of diversion troughs will be described more fully hereinbelow. Vapor is exhausted by use of the aperture 11 of the tank 1 to achieve the goal of explosion-protection and flameout device 5 is used to prevent the flame from being introduced into the tank in conjunction with the method of heat effect to achieve the goal of extinguishing a fire. Thus, a system and method of explosion-protection and fire-extinguishing an inflammable liquid storage tank 1 under the condition of high temperature is provided.

The flameout device 5 provided by this invention is installed above the aperture 11 on the top of tank 1, the upper end of the flameout device 5 used for vapor discharging. Flameout device 5 is made by combining many column-shaped pipes that lie parallel with the pipe's diameter.

As discussed hereinabove, the pipes are specified according to:

$D_o$<Ø25 mm, length $H=3D_o(\sqrt{D}+1)^2$ with a wall thickness of approximately 0.4 mm. Flameout device 5 couples with a valve of column-shape having a section diameter D equivalent to the aperture 11 bore. If flameout device 5 does not couple with a valve, it can be in many shapes. An external layer is covered firmly and closely by the covering and there are screw holes for installing and mounting. The column-shaped pipes and their coverings are made of stainless steel. The diameter of column-shaped pipes composing the flameout device has an inverse relation to explosion-protection and fire extinguishing characteristics. When the pipe diameter $D_o$>25 mm, the extinguishing function becomes poor but provides more explosion-protection. When diameter $D_o$<25 mm, the extinguishing function will increase while explosion-protection characteristics decrease. Therefore, it is necessary to obtain a balance. Preferably, Do is approximately 19 mm and section area S is approximately 283 $mm^2$ and the pipe height is defined as described hereinabove, i.e. $H=3D_o(\sqrt{D}+1)^2$. As pipe height is increased, there will be an increase in fire prevention and extinguishing efficiency but at a cost of a decrease in explosion-protection efficiency. Thus, a balance point is to be obtained and the formula will be $H=3D_o(\sqrt{D}+1)^2$.

In order to avoid heat quantity transmitting to the tank wall by the vapor burned above flameout device 5, a heatinsulation collar therefore must be added between the tank's aperture 11 and the flameout device 5.

When the heat source is farther from the tank and exerts an influence on the tank by heat radiation, the exhausting of flammable vapor that is produced from the flammable liquid in the tank may fill the air surrounding the flameout device 5. In order to avoid the danger of explosion, there must be sparking parts around the vapor outlets that cause the flammable vapor to be ignited as soon as it reaches the air.

A valve and pump can only work under a given working temperature range. In order to maintain the working temperature of a valve and pump, there must be protective casings made of heatinsulating material at the periphery of the valve and pump.

The explosion-protection and extinguishing safety deviceprovided according to the present invention includes a valve, heat insulation collar, and flameout device 5 placed vertically above the aperture 11 of the tank 1. The valve and tank 1 are tightly jointed with a flange. This safety device can prevent explosion when the covering of the tank is heated to high temperatures. The flame above the flameout device 5 may extinguish automatically after the influence of an external heat source has been eliminated. Under the condition of normal temperature, this safety device can also prevent fire even if the valve is open and the external heat source is above the tank.

The explosion-protection and extinguishing safety device provided according to the invention includes: the valve, which can open automatically when the pressure inside the tank or the temperature of the tank's walls reaches a certain threshold, installed vertically above the aperture 11 of the tank 1; a heat insulation collar which communicates and connects with the valve; a flameout device 5 that communicates and connects with the valve by the heat insulation collar; a protecting cap that covers the flameout device; and an igniting device that is located above the flameout device 5 and the protective casing that is provided outside the valve. The flameout device 5, heat insulation collar and valve preferably have a diameter D which is the same as the diameter of the aperture 11 at the top of the tank 1 and is circular in shape. In the flameout device 5, there are many column-shaped pipes arranged densely, side by side and parallel having diameter $D_o$, height H and wall thickness d.

The valve is preferably a driving valve and includes pressure sensors installed side by side for monitoring the pressure inside the tank. The sensors send out a signal when the pressure or temperature inside the tank reaches a certain value. The signal is then passed to a motor or an airoperated device. Thus, the motor or air operated device pass the signal again to the driving valve which causes the driving valve to open.

The explosion-protection and extinguishing safety device provided according to the invention preferably includes a floating basin sink that can be sunk. The floating basin sink includes a filling pump and an air extracting pump that extracts out the inflated substance in the sealing ring automatically when the tank's wall temperature reaches a preset value; a flange connected vertically at the aperture 11 of tank 1; a heat insulation collar which communicates and connects with the flange; a flameout device 5 which connects the flange through the heat insulation collar; a protecting cap that covers the flameout device 5; and an igniting device above the flameout device 5 and protective casing outside the pump. Because the aperture 11 of the tank 1 does not need to couple with the valve, the aperture of the tank 1 can be in circular shape or other various shapes but the shape of flange, flameout device and heat insulation collar is the same as the shape of the aperture 11 of the tank and each have sectional areas of So. There are many column-shaped pipes in the flameout device 5, arranged parallel, side by side and densely having diameter $D_o$, height H, and a wall thickness of d.

The explosion-protection and extinguishing safety device provided according to the invention includes a tank aperture 11 of sectional area SO, and corresponding aperture diameter D, their relationship with the stored liquid volume V of tank 1 is defined according to the following formula:

$$S_o=1.4\ nV(1+K)/\text{liter}(mm^2);\ D=\sqrt{1.78nV(1+K)/\text{liter}(mm^2)}$$

where n is explosion-protection safety coefficient, n≧1, V is in liters, and K is an obstruction parameter of wall thickness.

The explosion-protection and extinguishing safety device provided according to the invention preferably includes an outlet collecting trench fixed around the tank 1 for collecting the released flammable liquid. The outlet collecting trench is discussed more fully hereinbelow with reference to FIG. 3. The outside burning liquid can be extinguished automatically when it flows into the collecting trench.

With reference again to FIG. 1, a first embodiment of the present invention is illustrated. An aperture 11 on the top of tank 1 connects with a driving valve 3 through a flange 2 and a heat insulation collar 4. The driving valve 3 connects with a flameout device 5 through a heat insulation collar 4. There are many column-shaped pipes 6 arranged parallel and side by side in the flameout device 5. A protecting cap 7 is provided above the flameout device 5. Igniting devices 25 are installed around the upper end of the flameout device and there is a protective casing 26 in the periphery of the valve. A sensor 9 connects with a motor or an air operated device 10. Tank 1 is filled with flammable liquid 8. When the flammable liquid 8 in tank 1 is heated and expands as well as vaporizes, the sensor 9 inducts the pressure or temperature of the tank's wall and then send out an inductive signal in response thereto. When the pressure or temperature exceeds an allowed value, the sensor 9 will operate and send the inductive signal to themotor or air operated device 10 so that the motor or air operated device 10 engages the driving valve 3 to an open position. Thus, the pressure inside the tank 1 is decreased via opening of driving valve 3 thereby avoiding an explosion of tank 1 resulting from high pressure. During the reduction of pressure from tank 1, the flammable vapor 12 in the tank exhausts from aperture 11 through driving valve 3 and flameout device 5. When the flammable vapor 12 meets the tinder, burning will occur.

Because there is an action of the flameout device 5, the burning flame cannot enter tank 1 and ignite the flammable liquid 8 thereby ensuring the flame is burning only above the upper end of the flameout device 5. The flammable vapor released from tank 1 is consumed to avoid the environmental pollution that results from the entry of these vapors into the air. In addition, because heat insulation collar 4 is installed between driving valve 3 and flameout device 5, the heat produced by the fire above the upper end of the flameout device 5 cannot be conducted to tank 1. Tank 1 thereby avoids accepting more heat that would accelerate the rise of temperature, the increase of vaporization of flammable liquid 8 and the increase of vapor releasing load on the drivingvalve 3. In addition, the increase of vaporization of the flammable liquid 8 will also cause loss of flammable liquid.

Once the external heat source has no influence on tank 1, the flame above the flameout device 5 will extinguish automatically. In the first embodiment, the switch device of the aperture 11 of tank 1 is a driving valve 3 and the sectional shape is circular, thus both the tank's aperture 11 and flameout device 5 are generally of circular shape. The column-shaped pipes that form the flameout device may however equivalently be substituted with square pillar-shaped pipes, equilateral hexagon pillar-shaped pipes or isosceles trapezoid pillar-shaped pipes as shown in FIGS. 5A–5H. The different K values of pillar-shaped pipes are defined as follows )d commonly denoting the thickness of the pipe wall):

Column-shaped pipe:

$$K = 4.68\frac{d}{D_o},$$

where $D_o$ is the diameter of the column-shaped pipe;

Square pillar-shaped pipe:

$$K = \frac{2d}{D_o},$$

where $D_o$ is the diameter of the inscribed collar of square shape:

Equilateral hexagon pillar-shaped pipe:

$$K = 1.9\frac{d}{D_o},$$

where $D_o$ is the diameter of the inscribed collar of equilateral hexagon shape;

Isosceles trapezoid pillar-shaped pipe:

$$K = \frac{2d}{D_o},$$

where $D_o$ is the height of the isosceles trapezoid or mean value of the top side and bottom side;

The shape of the pillar-shaped pipe 6 is designated to define the value of K, the conditions of explosion-protection, fire prevention and extinguishing of tank 1 thereby defined as:

$$\frac{S}{25} \geq S_o \geq 1.4V(1+K)/\text{liter}(\text{mm}^2)$$

where $S_o$ is the sectional area of the tank's aperture 11 and the flameout device 5, S is sectional area of tank 1, and V is the volume (Liter) of the storage quantity of the tank 1.

The height of pillar-shaped pipe 6 in flameout device 5 is calculated by the following formula:

$$H=3D_o(D+1)^2 \text{ mm}$$

where $D_o$ is the internal diameter of pillar-shaped pipe 6, and D is the diameter (m) of the section of the tank's aperture and flameout device 5. With a value of D, the bore diameter of the driving valve can be designated.

Figure 2:
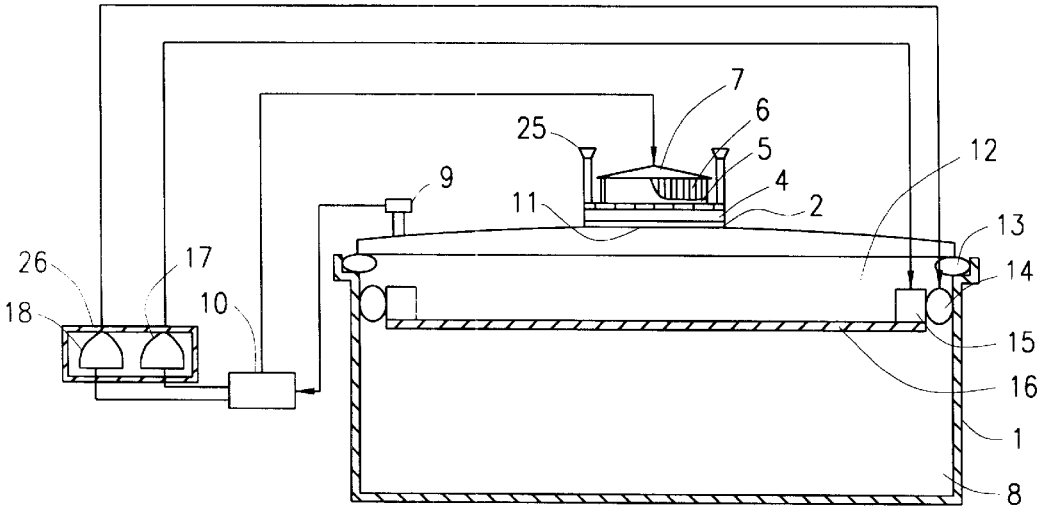

In FIG. 2 is illustrated a second embodiment of theinvention wherein tank 1 is a floating top structure oil tank. The aperture 11 on the upper end of the tank 1 connects with flange 2 and flange 2 connects flameout device 5 tightly by heat insulation collar 4. In the flameout device 5 there are pillar-shaped pipes that arrange side by side and parallel. A protecting cap 7 is provided above the flameout device 5. Igniting devices 25 are installed around the upper end of the flameout device 5 and there is a protective casing 26 at the periphery of the pump. Tank 1 is filled with flammable liquid 8. When the temperature of the wall of the tank covering exceeds an allowed value, sensor 9 operates and sends the inductive signal to a motor or air operated device 10 so that the motor or air operated device drives the liquid pump 16. Liquid is poured into floating basin 16 and floating cabin 15. The liquid in the floating basin 16 can produce vapor that can go into the space of tank 1 and mix with air. Because the volatility of flammable liquid 8 is generally strong, this mixed vapor will exceed its combustible concentration burning limit quickly. When a certain quantity of liquid has been poured into floating basin 16 and floating cabin 15, the floating basin 16 will sink to the bottom of tank 1 and the device 10 drives an air extracting pump 17 to extract the inflated substance in the sealing washer 14 out of the tank 1. The device 10 opens protecting cap 7 with a certain time delay for the signal in a manner that a large quantity of flammable vapor 12 is produced by liquid 8 in tank 1 without the obstruction of floating basin 16 and bag 14. To avoid an explosion of tank 1 caused by the increase of vapor inside, the vapor is continuously exhausted from aperture 11 through the flameout device 5 so as to relieve the pressure. When flammable vapor is let out and meets with a flame, it will combust. Because there is a preventive action of flameout device 5 and sealing washer 13, air cannot enter into tank 1 such that the burning flame cannot enter into tank 1 causing combustion of the liquid 8. The released flammable vapor from tank 1 is consumed so as to avoid these vapors entering into the air and causing environmental pollution. Furthermore, because heat insulation collar 4 is installed between flange 2 and flameout device 5, the fire above the flameout device 5 cannot conduct the heat to tank 1. Tank 1 thereby avoids accepting more heat which would accelerate the increase of temperature that would cause flammable liquid 8 to increase its vaporization. Once the influence of the external heat source has been eliminated, the flame above the flameout device 5 will extinguish automatically.

In this embodiment, the switch device of the aperture 11 of tank 1 is a floating top structure. The section of the tank's aperture 11 and flameout device 5 can be of circular shape or other shapes described hereinabove, the sectional area being defined as $S_o$. The generally pillar-shaped pipes that form flameout device 5 can be column-shaped, square pillar-shaped, equilateral hexagon pillar-shaped and isosceles trapezoid pillar-shaped as shown in FIGS. 5A–5H, the generally pillar-shaped pipes having different K value according to the specific shape as described hereinabove.

Figure 3:
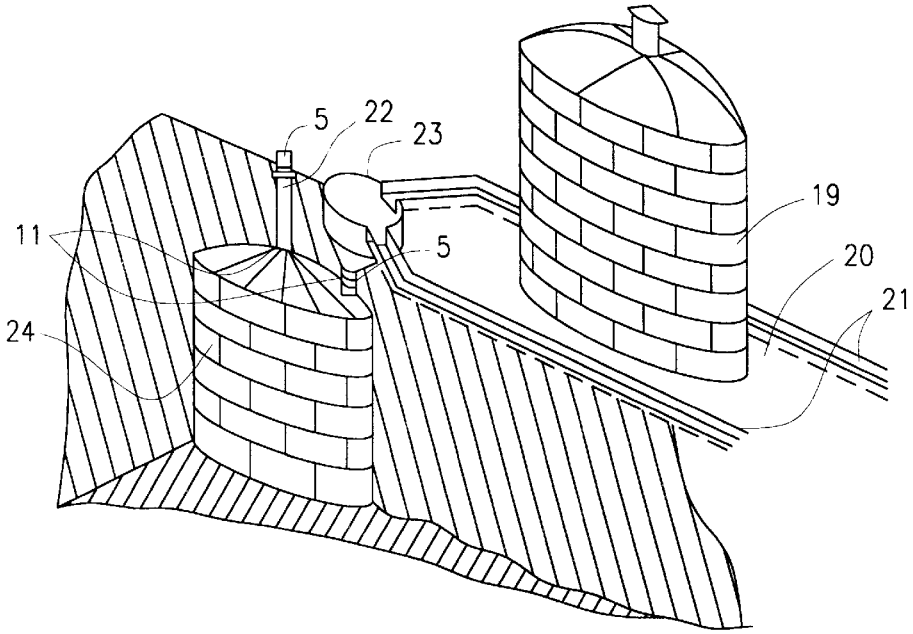
Figure 5A:
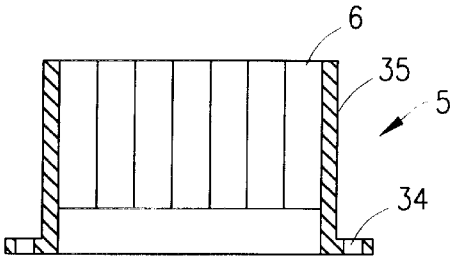
FIGS. 5A, 5B, 5C, 5D, 5E, 5F, 5G, 5H are, respectively, side cross-sectional views and top views of the flameout device of the safety device in the invention.
Figure 5B:
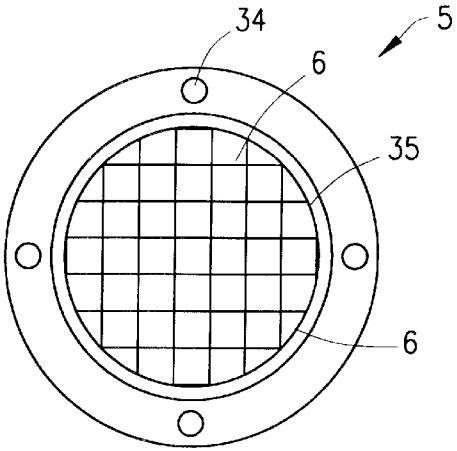

In FIG. 3 is illustrated a third embodiment of the present invention wherein a tank 19 is functionally equivalent to the tank in the above mentioned embodiments and has the safety device for explosion-protection and extinguishing. In order to make the tank 19 safer and decrease the consumption of inflammable liquid during fire, it is necessary to minimize the effect of burning fluid flowing out from other sources, i.e. from other tanks that may be burning in close proximity to tank 19. When the tank 19 is heated, sensor 9 will send an inductive signal to a motor or air operated device to open the aperture. The exhausted flammable vapor will burn when meeting with the flame above the flameout device 5. At the same time, it is also necessary to use the collecting trench 24 in a dual manner thereby providing tank 19 with a multiplicity of safety features. The action of collecting trench 24 is to direct the outflowing burning liquid into collecting basin 23 along a special passage 21 and then into collecting trench 24. The passage 21 ensures the burning liquid maintains a certain distance from the wall of tank's 19 covering, thereby allowing the burning liquid to extinguish automatically when flowing into collecting trench 24. The outflowing liquid is collected and the influence of the heat emanating therefrom on the tank's 19 liquid is thereby decreased. The collecting trench 24 is buried under ground 20. Collecting trench 24 communicates with the collecting basin 23 through a flameoutdevice 5 fixed on the collecting trench 24. When there is burning liquid that flows from the ground 20 to tank 19, the liquid flows along the discharge leading passage 21 into collecting basin 23 and then flows into collecting trench 24 through the flameout device 5. The burning liquid will extinguish automatically when flowing into collecting trench 24 and the exhausted vapor from collecting trench 24 will be extracted from the vapor discharge duct 22. In order to prevent the flame from entering into the liquid surface of the collecting trench 24, it is also necessary to install another flameout device **5*b* on the top end of vapor discharge duct 22. When the flowing burnt liquid completes collecting in trench 24, there remains no burning liquid in discharge leading passage 21 and collecting basin 23. The flame above the flameout device will then extinguish automatically. This will quickly decrease the high heat influence and conduction on tank 19 from the burning liquid so as to prevent the liquid in tank 19 from being heated by the high temperature associated with the burning, flowing liquid thereby providing further safety of tank 19**.

The operation of the discharge leading trough is as follows. Two apertures are opened on the top face of the closed tank 19, one aperture as an aperture for filling liquid connected with a collecting trench, a second aperture for vapor-venting. The liquid filling aperture and vapor-venting aperture communicate and connect with flameout devices 5 and 5*b*. The leaked burning liquid that flows into the collecting trench through the liquid filling aperture can extinguish automatically.

Provided the section area of the liquid filling aperture and vapor discharge duct aperture are $S_{01}$ and $S_{02}$ respectively, then $S_{01}+S_{02}<S/25$, where S is the cross sectional area of the collecting trench tank, and $S_{01} \geqq S_{02}$. Taking the diameter of a pillar-shaped pipe in flameout device $D_o$=16 mm and height $H=48(\sqrt{D}+1)^2$, the fire extinguishing function of the discharge leading and collecting trenches are defined.

As the distance increases, the quantity of heat from heat radiation conduction will be weakened. Although the influence of heat radiation on tank 19 is not so great that the flame contacts with the tank 19 directly, but rather a long period of heat radiation will also cause explosion and combustion of the tank 19. The tank 19 equipped with the safety device taught according to the present invention can let out vapor automatically when the tank's wall reaches a specially designated temperature. It also has enough vapor-out quantity to overcome the influence of outside heat sources and protects tank 19 from explosion. Although flammable vapor physically remote from a combustion source may not be ignited immediately, if a great quantity of flammable vapor is exhausted into the air explosion and burning may still occur. Therefore, an automatic igniting device, e.g. flameout device 5*b*, must be set up at the outlet of the flammable vapor. The flame burns above the flameout device 5*b*, and once the outside heat source has been eliminated, i.e. once any accumulated inflammable vapor has been burned by flameout device 5*b*, the flame above the flameout device 5*b* will extinguish automatically.

Figure 4A:
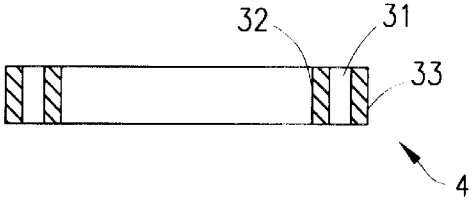
FIG. 4A and FIG. 4B are, respectively, a side, cross-sectional view and a top view of the heat insulation collar of the safety device according to a preferred embodiment of the present invention.
Figure 4B:
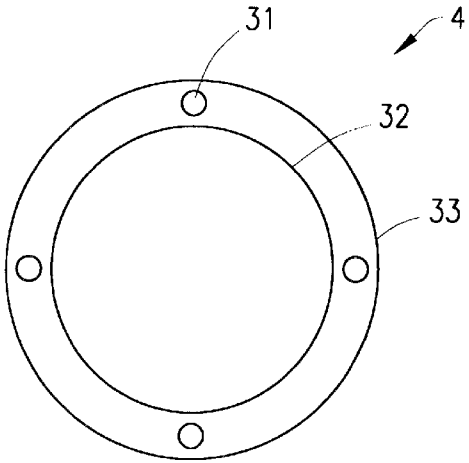
Figure 5G:
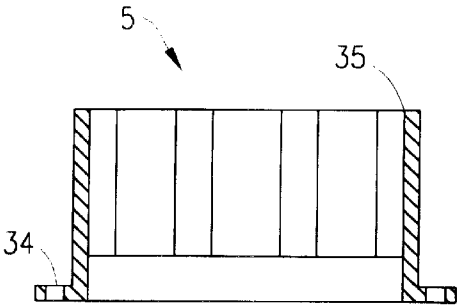
Figure 5H:
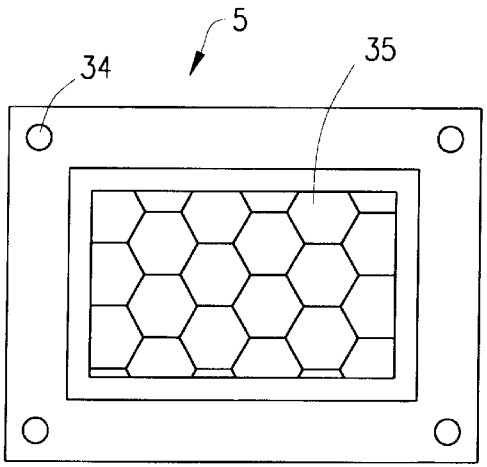
Figure 5E:
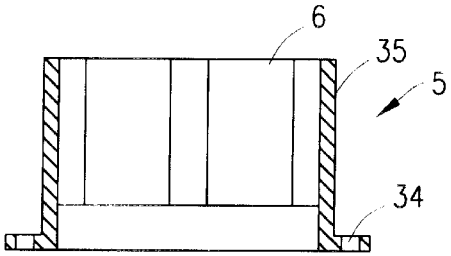
Figure 5F:
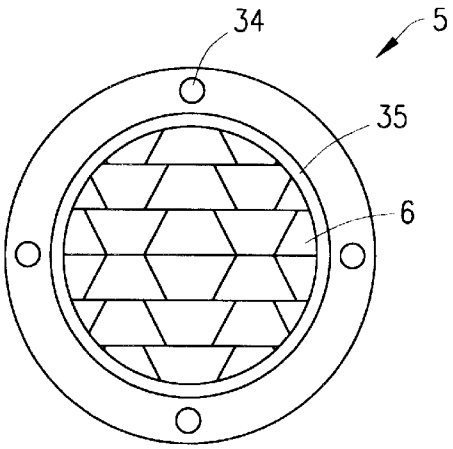
Figure 5C:
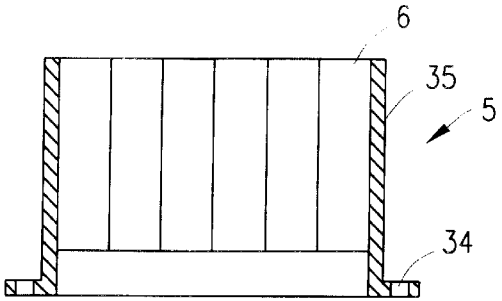
Figure 5D:
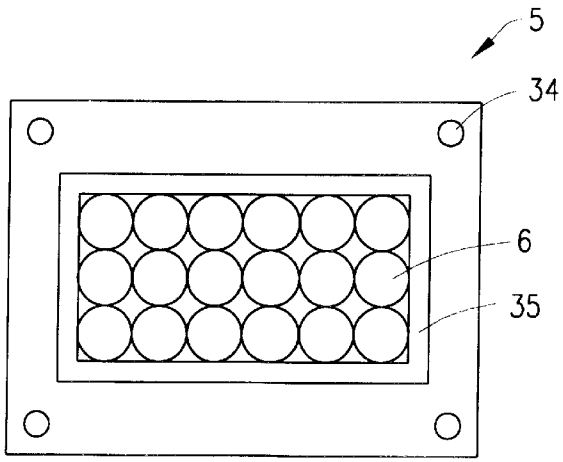

The heat insulation collar taught by the present invention is shown in FIGS. 4A and 4B wherein reference sign 31 indicates a screw hole, 32 is the internal diameter which is approximately equal to the size of the valve bore, and 33 is the external diameter which is approximately equivalent to the size of the valve's casing. It is preferably made of refractory and heat-insulating material.

The flameout device provided by the invention is shown in FIGS. 5A, 5B, 5C, 5D, 5E, 5F, 5G, and 5H. Its main function is automatic extinguishing and also separating the flame from the oil surface and fire prevention at normal temperature. The flameout device is mainly formed by many pillar-shaped pipes 6 that are arranged in parallel and combined into a cellular body. The outer layer of the body is an external casing 35 that closely connects with the cellular body. There is a screw hole 34 on the external casing 35 for convenient mounting and connecting of the heat-insulation collar 4 and valve 3 by screws. Protecting cap 7 is set up above the flameout device (see FIG. 1, FIG. 2 and FIG. 3). Flameout device 5 and external casing 35 are preferably made of stainless steel or other high-temperature resistance material in order to prevent rust invading into valve 3 that would thereby impair the quality of valve 3. The external diameter of the cellular body that forms flameout device 5 is approximately equal to the size of aperture 11 or passage of valve 3. The size of the diameter of the pillar-shaped pipes 6 that form flameout device 5 has a direct influence on the action of extinguishing and explosion-protection. It has an inverse influence on the two, therefore a balance between extinguishing and explosion-protection characteristics are had by selecting a value of $D_o$=18±3 mm.

Test Procedure

Figure 6:
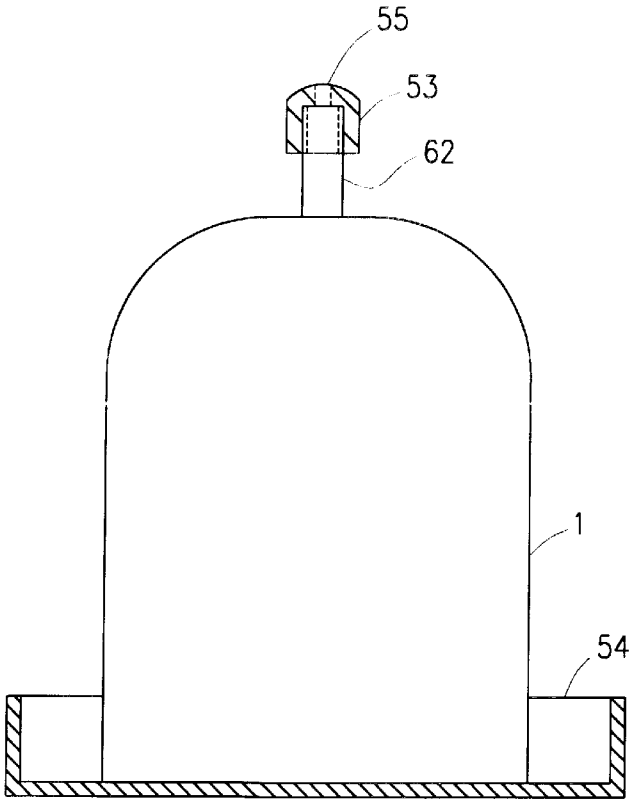
FIG. 6 is a side, cross-sectional view of an explosion testing device of the present invention.

I. Explosion Test:

The test purpose is to find the ratio value between the bore diameter of the tank's aperture and liquid volume for the optimal safety features provided thereby. The testing device is shown in FIG. 6. Three tanks 1 made of thin iron sheet with supporting strength of 1.6 kg/cm and a volume of 5.6 liter are selected. The open aperture of 50.8 mm, 25.4 mm and 19.05 mm respectively on the top of the tanks is welded with the same 100 mm length iron pipe 52 of corresponding hole sizes. A flameout device is set up at the pipe aperture of 50.8 mm. There is a screw thread on another end of the 19.05 mm iron pipe and five pipe-caps 53 areprovided with drilled holes 55 of 8 mm, 5 mm, 3 mm, 2.5 mm and 2 mm respectively. Eight tests were performed as follows:

Step 1) A tank 1 with a 50.8 mm aperture was used and was filled with 5 liters of gasoline. The tank is placed on the basin 54 that is 270 mm large and having a height of 100 mm. A quantity of gasoline is also filled in basin 54 and then the gasoline in basin 54 is ignited. The tank becomes heated in the fire. After 2 or 3 minutes, the vapor escaping above the pipe aperture is burnt and the gasoline in tank 1 is vaporized completely. The tank neither exploded nor deformed.

Step 2) A tank 1 with a 25.4 mm aperture was used and was filled with 5 liters of gasoline. The tank was placed on the basin 54 and filled with gasoline. The same heating procedure was repeated and the gasoline in tank 1 was vaporized completely. The tank was neither exploded nor deformed.

Step 3) A tank 1 with a 19.05 mm aperture was used and was filled with 5 liters of gasoline. The tank was placed on the basin 54 and filled with gasoline. The same heating procedure was repeated and the gasoline in tank 1 was vaporized completely. The tank neither exploded nor deformed.

Step 4) A tank 1 with a 19.05 mm aperture was used and was filled with 5 liters of gasoline. A pipe cap 53 with a drilled hole 55 of 8 mm was put on the aperture of pipe 52. The tank was placed on the basin 54 and filled with gasoline. The same heating procedure was repeated and the gasoline in tank 1 was vaporized completely. The tank neither exploded nor deformed.

Step 5) A tank 1 with a 19.05 mm aperture was used and was filled with 5 liters of gasoline. A pipe cap 53 with a drilled hole 55 of 5 mm is put on the aperture of pipe 52. The tank was placed on the basin 54 and filled with gasoline. The same heating procedure was repeated and the gasoline in tank 1 was vaporized completely. The tank was neitherexploded nor deformed.

Step 6) A tank 1 with a 19.05 mm aperture was used and was filled with 5 liters of gasoline. A pipe cap 53 with a drilled hole 55 of 3 mm was put on the aperture of pipe 52. The tank was placed on the basin 54 and filled with gasoline. The same heating procedure was repeated and the gasoline in tank 1 was vaporized completely. The tank neither exploded nor deformed.

Step 7) A tank 1 with a 19.05 mm aperture was used and was filled with 5 liters of gasoline. A pipe cap 53 with a drilled hole 55 of 2.5 mm was put on the aperture of pipe 52. The tank was placed on the basin 54 and filled with gasoline. The same heating procedure was repeated and the gasoline in tank 1 was vaporized completely. The tank did not explode but was lightly deformed.

Step 8) A tank 1 with a 19.05 mm aperture was used and was filled with 5 liters of gasoline. A pipe cap 53 with a drilled hole 55 of 8 mm was put on the aperture of pipe 52. The tank was placed on the basin 54 and filled with gasoline. The same heating procedure was repeated and the gasoline in tank 1 was vaporized completely. The tank 1 neither exploded nor deformed. For the above testing procedures, vapor is discharged at the aperture of pipe 52, all the vapor is burnt and the combustion intensity is changed with respect to the size of the tank's aperture: the smaller the bore diameter, the greater the resulting combustion intensity. The vapor flow ejecting from a hole of 2 mm is most violent.

Testing results:

For the tank 1 filled with 5 liters of gasoline being heated to high temperature, the discharge quantity is maximized when the liquid in tank 1 has been in a boiling state. The bore diameter of 3 mm is the smallest bore diameter utilized for a tank being unexplosive. Therefore the ratio of section area S of minimum safety aperture of tank to volume V, $y=S/V$, $y_o=\pi r^2/5$ liter$=(3.14\times1.5^2\ mm^2)/5$ liter$=1.4\ mm^2$/liter.

The bore diameter of the tank's aperture is preferably $D>3$ mm, with an increase in bore diameter producing less explosive tank characteristics. Therefore, the ratio of section area of safety aperture of the tank 1 to volume of liquid $y\geqq1.4\ mm^2$/liter.

II. Extinguishing Test:

The test purpose is to determine the size of bore diameter D of pillar-shaped pipe 6 of flameout device 5 and the height of the pipe and to determine the extinguishing characteristics associated therewith.

Figure 7:
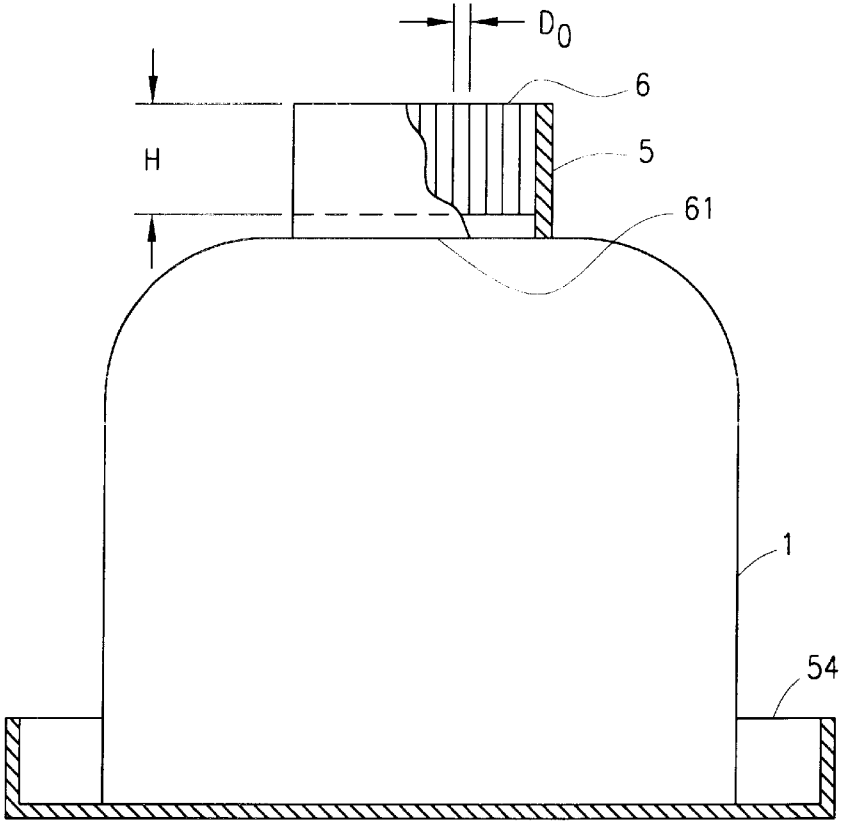
FIG. 7 is a side, cross-sectional view of a fire extinguishing testing device of the present invention.

The extinguishing testing device is shown in FIG. 7 and includes a tank 1, a flameout device 5, a pillar-shaped pipe 6, and a heating basin 54. The test procedure is carried out as follows:

Step 1) A pillar-shaped tank (not shown) with diameter of 120 mm and a height of 180 mm without an upper cover is used. It is filled with a volume of gasoline approximately equal to two-fifths of the tank volume and then ignited. Gasoline is burnt. The flame is inside the tank and combustion does not stop until the gasoline has been burnt completely.

Step 2) A pillar-shaped tank with a diameter of 120 mm and a height of 180 mm without an upper cover is used. It is filled with a volume of gasoline approximately equal to two-fifths of the tank volume and a fine metal net is used to cover the aperture of the tank 1. The tank 1 is placed on basin 54 that is filled with gasoline. The gasoline in the basin 54 is ignited to heat the tank 1. Soon there is a burning flame on the metal net and the flame does not enter into the tank 1. The gasoline in the basin is extinguished when it has been burnt out. The flame on the metal net is still burning continuously until the gasoline in the tank 1 has burnt out.

Step 3) A tank 1 with a section diameter of 300 mm as the testing device shown in FIG. 7 is used. An aperture 61 of 120 mm is opened on the top and soldered with a flameout device 5 that has a diameter of 120 mm and a height of 180 mm. The pillar-shaped pipes 6 forming the flameout device 5 have a diameter D of 25 mm and height H of 180 mm. Approximately two-thirds of the tank 1 volume is filled with gasoline. Tank 1 is then placed on the basin 54 that is filled with the proper quantity of gasoline. The gasoline in basin 54 is ignited to heat the tank 1 to a high temperature. There is a burning flame above the flameout device 5. When the gasoline in the basin 54 has been burnt out, the flame above the flameout device 5 will weaken but the flame invades the upper end of pillar-shaped pipe 6. The fire intensity is small and weak and the flame does not extinguish until a necessary object covers the aperture (e.g. wooden board, thick carton).

Step 4) A tank 1 with section diameter of 300 mm is used. An aperture 61 of 120 mm is opened on the top and soldered with a flameout device 5 that has a diameter of 120 mm and a height of 180 mm. The pillar-shaped pipes 6 forming the flameout device 5 have a diameter D of 19 mm and a height H of 180 mm. Two-thirds of the volume of tank 1 is filled with gasoline. Tank 1 is then placed on basin 54 that is filled with the proper quantity of gasoline. The gasoline in basin 54 is ignited to heat the tank 1 to a high temperature. There is a burning flame above the flameout device 5 soon thereafter. The flame does not enter into the tank 1. When the gasoline in basin 54 has been burnt out, the flame above flameout device 5 will extinguish automatically at once.

Step 5) A tank 1 with a section diameter of 300 mm is used. An aperture 61 of 120 mm is opened on the top and soldered with a flameout device 5 that has a diameter of 120 mm and a height of 180 mm. The pillar-shaped pipes 6 forming the flameout device 5 have a diameter D of 19 mm and height H of 120 mm. Two-thirds of the volume of tank 1 is filled with gasoline. Tank 1 is then placed on the basin 54 that is filled with the proper quantity of gasoline. The gasoline in basin 54 is ignited to heat the tank 1 to a high temperature. There is a burning flame above the flameout device 5 soon thereafter. The flame does not enter into the tank. When the gasoline in basin 54 has been burnt out, the flame above flameout device 5 will extinguish automatically at once.

Step 6) A tank 1 with section diameter of 300 mm is used. An aperture 61 of 120 mm is opened on the top and soldered with a flameout device 5 that has a diameter of 120 mm and a height of 180 mm. The pillar-shaped pipes 6 forming the flameout device 5 have a diameter D of 19 mm and height H of 70 mm. Two-thirds of the volume of tank 1 is filled with gasoline. Tank 1 is then placed on basin 54 that is filled with the proper quantity of gasoline. The gasoline in basin 54 is ignited to heat the tank 1 to a high temperature. There is a burning flame above the flameout device 5 soon thereafter. The flame does not enter into the tank. When the gasoline in basin 54 has been burnt out, the flame above flameout device 5 will extinguish automatically at once.

Step 7) A tank 1 with section diameter of 300 mm is used. An aperture 61 of 120 mm is opened on the top and soldered with a flameout device 5 that has a diameter of 120 mm and a height of 180 mm. The pillar-shaped pipes 6 forming the flameout device 5 have a diameter D of 19 mm and height H of 40 mm. Two-thirds of the volume of tank 1 is filled with gasoline. Tank 1 is then placed on basin 54 that is filled with the proper quantity of gasoline. The gasoline in basin 54 is ignited to heat the tank 1 to a high temperature. There is a burning flame above the flameout device 5 soon thereafter. The flame does not enter into the tank 1. When the gasoline in basin 54 has been burnt out, the flame above flameout device 5 does not extinguish until the gasoline in tank 1 has vaporized completely.

Step 8) Four tanks 1 with section diameter of 300 mm are used. An aperture 61 of $S_o$=120 mm, $S_o$=80 mm, $S_o$=60 mm and $S_o$=40 mm respectively is opened on the top and soldered with a flameout device 5 that has a corresponding diameter of 120 mm, 80 mm, 60 mm and 40 mm, respectively. The pillar-shaped pipes 6 forming the flameout device 5 have a diameter $D_o$ of 19 mm and height H of 90 mm. Two-thirds of the volume of tank 1 is filled with gasoline. The four tanks 1 are then placed on basins 54 that are filled with the proper quantity of gasoline. Each tank is placed approximately the same distance of 200 mm from basin 54. The gasoline in basins 54 is ignited to heat the tanks 1 by heat radiation. After a period of time there is a burning flame above the flameout device 5. The flame does enter into the tank with aperture $S_o$=80 mm and $S_o$=120 mm but not for $S_o$=60 mm and $S_o$,=40 mm. When the gasoline in basin 54 has been burnt out, the flames continue burning in the tanks with the two former apertures, and the flame above flameout device 5 extinguishes automatically in the tanks with the two latter apertures.

Step 9) A tank 1 with section diameter of 300 mm is used. An aperture 61 of $S_o$=S=300 mm is opened on the top and soldered with a flameout device 5. The pillar-shaped pipes 6 forming the flameout device 5 have a diameter $D_o$ of 19 mm and height H of 130 mm that is parallelly spread over the whole section of the aperture. The flameout device 5 has a section diameter of $S_o$ equivalent to the section diameter S of the tank, i.e. $S_o$=S. Two-thirds of the volume of tank 1 is filled with gasoline. Tank 1 is then placed on basins 54 that are filled with the proper quantity of gasoline. The tank is kept an approximate distance of 200 mm or so from basin 54. The gasoline in basins 54 is ignited to heat the tanks 1 by heat radiation. After a period of time there is a burning flame above the flameout device 5. The flame does enter into the tank 1. When the gasoline in basin 54 has been burnt out, the flames in the tank 1 continue burning. Some gasoline is then refilled into the first basin 54 and ignited and burnt to heat the tank 1 directly. There is a very big flame above the aperture of tank 1. When the gasoline in the basin has burnt out and extinguished, the flame above the aperture of tank 1 extinguishes automatically. Some gasoline in tank 1 remains. Some gasoline is refilled into the first basin 54 again and ignited and burnt to heat tank 1 directly again. There is a very big flame above the aperture of tank 1 again. When the gasoline in the basin has burnt out and extinguished, the flame above the aperture of tank 1 extinguishes automatically again. When there still is some gasoline in tank 1, the same step is repeated again and again. The result is just the same. The use of the flameout device through the action of heating the liquid in tank 1 makes the flame burning in tank 1 and above the flameout device extinguish automatically.

Testing Results:

The automatic extinguishing device provided according to the invention wherein the flameout device 5 formed by many parallel arranged pillar-shaped pipes 6 does not only play a part of fire obstruction but also plays a role of extinguishing. When the diameter of pillar-shaped pipes 6 forming the flameout device 5 is $D_o$>25 mm accompanied with an increase of diameter of pillar-shaped pipes 6, the extinguishing function weakens gradually. When $D_o$<25 mm accompanied with a decrease of diameter, the extinguishing function strengthens gradually. When the diameter $D_o$ of pillar-shaped pipes 6 is equal to 19 mm, there has been an evident extinguishing function.

The height of the pillar-shaped pipes 6 forming the flameout device also has an influence on the extinguishing function. The height of the pillar-shaped pipes H=60 mm, H=120 mm, H=180 mm or longer, i.e. H>3$D_o$, all can play a part in extinguishing. When H<3$D_o$, the extinguishing function will weaken gradually even to a point of providing no extinguishing function at all.

Synthesize Testing Results of I and II:

When $S_o$>S/25, a flame enters into the tank 1. Theflameout device 5 has lost the fire prevention function;

When $S_o$<S/25, a flame does not enter into the tank 1, and thus the flameout device 5 plays a part in fire prevention; From I above, the following relation is obtained: the ratio y=$S_o$/V>1.4 $mm^2$/liter, From the above formula it is know that, with tank 1 having a volume V, a minimum safety bore diameter of aperture S=1.4V$mm^2$/liter is required. The larger the bore diameter of the aperture of tank 1, the more safety that is provided, i.e. no explosion will occur. From II above, it is know that when $D_o$<25 mm accompanied with a decrease of diameter $D_o$ of pillar-shaped pipe 6, the extinguishing function will strengthen gradually. When $D_o$=19 mm, there has been an evident extinguishing function. The height of the pillar-shaped pipe H>3$D_o$, the higher the height is, the more powerful the extinguishing function is. When H<3$D_o$, the shorter the height is, the worse the extinguishing function is. H obtained from the experiments relates to D and $D_o$, as follows:

$$H=3D_o(\sqrt{D}+1)^2 \text{ mm}$$

where H is the height of the pillar-shaped pipes of the flameout device; $D_o$ is the diameter of the pillar-shaped pipe (unit is mm); and D is the internal diameter of the flameoutdevice's section or bore diameter of the aperture (unit is meter)

The conditions of fire prevention regarding the flameout device are:

$$D_o<\phi 25 \text{ mm}, H=3D_o((\sqrt{\sqrt{D}}+1)^2, S_o \leqq S/25$$

And the conditions for extinguishing the flameout device are:

$$D_o<\phi 25 \text{ mm}, H=3D_o((\sqrt{D}+1)^2, S_o<s$$

where S is the section area of the tank; $D_o$ is the bore diameter of the pillar-shaped pipe of the flameout device; and D is the bore diameter of the tank's aperture.

Conditions of explosion-protecting, fire prevention and extinguishing of tank are:

$$S/25>S_o \geqq 1.4V(1+K)/\text{liter}(mm^2),\ D_o<\phi 25 \text{ mm},\ H=3D_o(\sqrt{D}+1)^2$$

The preceding part has described the optimum embodiments, the purpose is to explain the invention but not to limit the exact form of the invention. The examples are not the whole of embodiments of the invention. From the above-mentioned technical guide or the embodiments of the invention, it is possible to obtain various revised and changed forms. In order to explain the conception of the invention and its practical use, some embodiments of the invention are selected and described, with these examples those skilled in the art can use the various embodiments and revised schemes in cases of suitability and special purpose. The subject matter and its equivalency of the invention is limited by the claims of the invention.

What is claimed is:

1. An explosion-protecting and extinguishing safety device for an inflammable liquid storage tank, said safety device comprising:

at least one aperture located on a top portion of said tank;

a switch device for said aperture being controlled by an automatic system, said switch device opening the aperture automatically and releasing a quantity of vapor when the temperature of a wall of said tank exceeds a preset value, the relation defining the safety device being defined by the equation:

$$S_o=1.4\ nV(1+K)/\text{liter mm}^2$$

where $S_o$ is the cross-sectional area of said aperture; V is the volume of said inflammable liquid storage tank; n is a safety coefficient, n being greater than or equal to one; K is an obstruction parameter of a respective wall of a pillar-shaped pipe located in a flameout device, the piller-shaped pipe being defined by the following relation:

$$H=3D_o(\sqrt{D}+1)^2 \text{ mm}, \phi 25 \text{ mm}<D_o<\phi 25 \text{ mm}, S/25>S_o>1.4V(1+K)/\text{liter mm}^2$$

where H is the height of said pillar-shaped pipe; $D_o$ is the diameter of said pillar-shaped pipe in said flameout device; D is the bore diameter of said aperture; and S is the cross-sectional area of said tank; and said flameout device including a plurality of pillar-shaped pipes arranged in parallel with a vapor-out aperture on an upper end of said flameout device, said flameout device being installed vertically above said aperture on said top portion of said tank, the vapor-out aperture having a diameter and a cross-sectional area approximately equal to said tank aperture.

2. The safety device according to claim 1, wherein said switch device comprises:

a floating basin which sinks within said tank when the temperature of said wall reaches said preset value; and a liquid pump for receiving an inductive signal to initiate operation thereof, said inductive signal transmitted in response to said temperature reaching said preset value, said liquid pump responding to reception of said inductive signal by pumping liquid on said floating basin and extracting an inflated substance from a sealing ring.

3. The safety device according to claim 1, wherein said switch device further comprises:

a driving valve;

at least one temperature sensor installed on a respective wall of said tank; and a device connected with said at least one temperature sensor to open said driving valve when the temperature of said respective wall reaches said preset value.

4. The safety device according to claim 3, wherein said device connected with said at least one temperature sensor is a motor.

5. The safety device according to claim 3, wherein said device connected with said at least one temperature sensor is air operated.

6. The safety device according to claim 1, wherein the safety device is mounted on ground adjacent said tank, said safety device further comprising:

a collecting trench laid out for collecting leaked inflammable liquid, wherein two apertures are opened from a closed position, a first aperture for receiving a liquid, and a second aperture for discharging vapor; and a duct exposed on said ground, said duct connected with said second aperture, the first aperture and the duct communicate and connect with said flameout device so that liquid flowing out therefrom is collected into said collecting trench through a discharge leading passage and collecting basin the first and second aperture dimensions being defined by the relations:

$$S_{01}+S_{02}\leqq S/25, \text{ and } S_{01}\geqq S_{02};$$

$$D_o=\phi 16 \text{ mm}; H=48(\sqrt{D}+1)^2 \text{ mm}$$

where $S_{01}$ is the sectional area of the first aperture, and $S_{02}$ is the sectional area of said second aperture.

7. The device according to claim 1, wherein the diameter Do of said pillar-shaped pipe in said flameout device is 18±3 mm and the wall thickness of said pipes is 0.4±0.1 mm.

8. The safety device according to claim 2, further comprising a heat insulation collar made of refractory and heat-insulating material, said collar installed between a flange and a valve.

9. The device according to claim 2, further comprising a protecting cap made of stainless and anti-corrosion material, said protecting cap being installed above said flameout device.

10. The device according to claim 2, further comprising a protective casing made of refractory and heat insulating material, said protective casing surrounding a valve and said pump.

* * * * *